United States Patent [19]

Nolte

[11] 4,398,416

[45] Aug. 16, 1983

[54] DETERMINATION OF FRACTURING FLUID LOSS RATE FROM PRESSURE DECLINE CURVE

[75] Inventor: Kenneth G. Nolte, Tulsa, Okla.

[73] Assignee: Standard Oil Company (Indiana), Chicago, Ill.

[21] Appl. No.: 290,635

[22] Filed: Aug. 6, 1981

Related U.S. Application Data

[63] Continuation of Ser. No. 71,953, Aug. 31, 1979, abandoned.

[51] Int. Cl.[3] ..... E21B 49/00

[52] U.S. Cl. ..... 73/155

[58] Field of Search ..... 73/155; 166/308, 305 R, 166/250.

[56] References Cited

U.S. PATENT DOCUMENTS 3,254,719 6/1966 Root ..... 166/308

OTHER PUBLICATIONS

Nordgren, R. P., Propagation of a Vertical Hydraulic Fracture, Soc. of Petroleum Engineers Journal, pp. 306–314, Aug. 1972.

Kaspereit, D. H., Fracture Design for Suspended Sand Packs, 54th Annual Tech. Conf. and Exhibition, AIME, Sep. 1979.

Komar, C. A. et al., Practical Aspects . . . Devonian Shale, 54th Annual Tech. Conf. and Exhibition, AIME, Sep. 1979.

Nolte, K. G., Determination of Fracture . . . Decline, 54th Annual Tech. Conf. and Exhibition, AIME, Sep. 1979.

*Primary Examiner*—Jerry W. Myracle

*Attorney, Agent, or Firm*—Scott H. Brown; Fred E. Hook

[57] ABSTRACT

The fluid loss during the extension of a fracture into a subterranean formation is determined from pressure decline measurements of a calibration fracture extending from a wellbore into subterranean formation. During the decline of the calibration fracturing treatment pressure, the period of time while the pressure decline is primarily controlled by fluid loss is selected. The fluid loss coefficient for fracturing fluids having similar characteristics is determined from the pressure decline during the selected period of time.

6 Claims, 5 Drawing Figures

PRESSURE DECLINE DIFFERENCES BETWEEN REFERENCE TIME AND LATER TIME AFTER FRACTURING MUDDY J SAND

OVERLAY OF IDEALIZED PRESSURE DECLINE DIFFERENCES ON PRESSURE DECLINE DIFFERENCES BETWEEN REFERENCE TIME AND LATER TIME AFTER FRACTURING MUDDY J SAND

DETERMINATION OF FRACTURING FLUID LOSS RATE FROM PRESSURE DECLINE CURVE

This is a continuation, of application Ser. No. 071,953, filed Aug. 31, 1981, now abandoned.

SUMMARY OF THE INVENTION

The pressure decline after a fracturing treatment is due in part to the loss of fracturing fluid into the formation to which the fracture extends. By measuring this pressure decline and selecting the time period during the pressure decline when this loss of fracturing fluid is the primary factor contributing to the pressure decline, the fluid loss coefficient of the fracturing fluid in the formation can be determined. A curve matching procedure is described for selecting the time period when fluid loss is the primary factor contributing to the pressure decline and a mathematical relationship is described for determining the fluid loss coefficient of the fracturing fluid in the formation.

DETAILED DESCRIPTION OF THE INVENTION

In the fracturing of subterranean formations, temperature and shear degradation alter the fluid loss characteristics of a fracturing fluid as it flows along a fracture from the wellbore toward the tip of the fracture. This degradation as well as the characteristics of a subterranean formation are difficult to simulate in laboratory evaluations of fracturing fluids. Simulation difficulties and the uncertainties associated therewith are alleviated by the method of this invention whereby the fluid loss characteristics of the fracturing fluid are determined during the closure of a fracture extending into the subterranean formation to be fractured. This is particularly important when gelled or emulsion fracturing fluids are used for fracturing subterranean formations.

The fluid loss characteristics of a fracturing fluid are currently used for determining the volume of fracturing fluid required for extending a fracture into a subterranean formation. By the method of this invention, an improved process is described for determining these fluid loss characteristics.

The fluid loss characteristics of a fracturing fluid, in the process of this invention, is determined by conducting a calibration treatment with the fracturing fluid of interest in the formation to be fractured. The calibration treatment can be the pumping of the pad prior to the fracturing treatment, a previous fracturing treatment with a similar fracturing fluid or a dedicated calibration treatment in the formation of interest.

In the process of this invention, the fluid loss characteristics of the fracturing fluid are determined from the pressure on the fluid in a fracture after a calibration fracturing treatment is terminated. At the termination of the calibration fracturing treatment, the well is shut-in and the pressure on the fracturing fluid is monitored. Pressure on the fluid is at a maximum at the termination of the fracturing treatment and thereafter decreases with time.

The decline of the pressure of the fluid is not constant. Immediately after the well is shut-in, the pressure decreases at a much more rapid rate than during the remainder of the fracture closure time. It is thought that this rapid pressure decline rate is contributed to by the extension of the fracture after the well is shut-in. The fracture can continue to extend, as evidenced by the high rate of pressure decline, for about 25–50% of the pumping time involved in extending the fracture. As the pressure on the fluid approaches the fracture closure pressure, the pressure decreases at a much slower rate than during the earlier times during fracture closure. It is thought that this reduced rate is caused by a portion of the fracture closing on itself or propping agents. The extension of the fracture and the closure of the fracture affect the rate of pressure decline. However, throughout the period while the fracture pressure is declining, fluid is also being lost to the permeable formation through which the fracture extends. The rate of fluid loss, at least in part, depends on the age of the fracture, with the fluid loss rate decreasing as the age of the fracture increases.

BRIEF DESCRIPTION OF THE DRAWINGS

This change in rate of pressure decline is illustrated with respect to FIG. 1. FIG. 1 shows that pressure decline after a fracturing treatment conducted in the Muddy J sand of the Denver Basin. In this fracturing treatment, the Muddy J sand was fractured at a depth of about 7900 ft (2408 m) by pumping about 500 bbls (80 $m^3$) of polyemulsion fracturing fluid with no proppant at about 5 bbls/min (795 l/min) into the fracture. The fracturing fluid was pumped into the fracture for about 100 minutes. The polyemulsion fracturing fluid consisted of about two-thirds condensate and one-third water with 50 lbs of polymer per 1000 gallons of water. The resulting fracture had a height of about 60 ft as determined by a temperature log and a fluid loss height of about 32 ft (23 kg) as determined by an SP log. The Muddy J sand at this location has a temperature of about 265° F., a permeability of about 0.01 md and a formation modulus of about $5\times10^6$ psi ($3.4\times10^7$ kPa). The fracture closure pressure of the Muddy J sand at this location is about 750 psi (5168 kPa) (surface pressure) as determined by pump-in/flowback testing. The bottomhole fracture closure pressure is the sum of the surface pressure and the static hydrostatic pressure.

Figure 1:
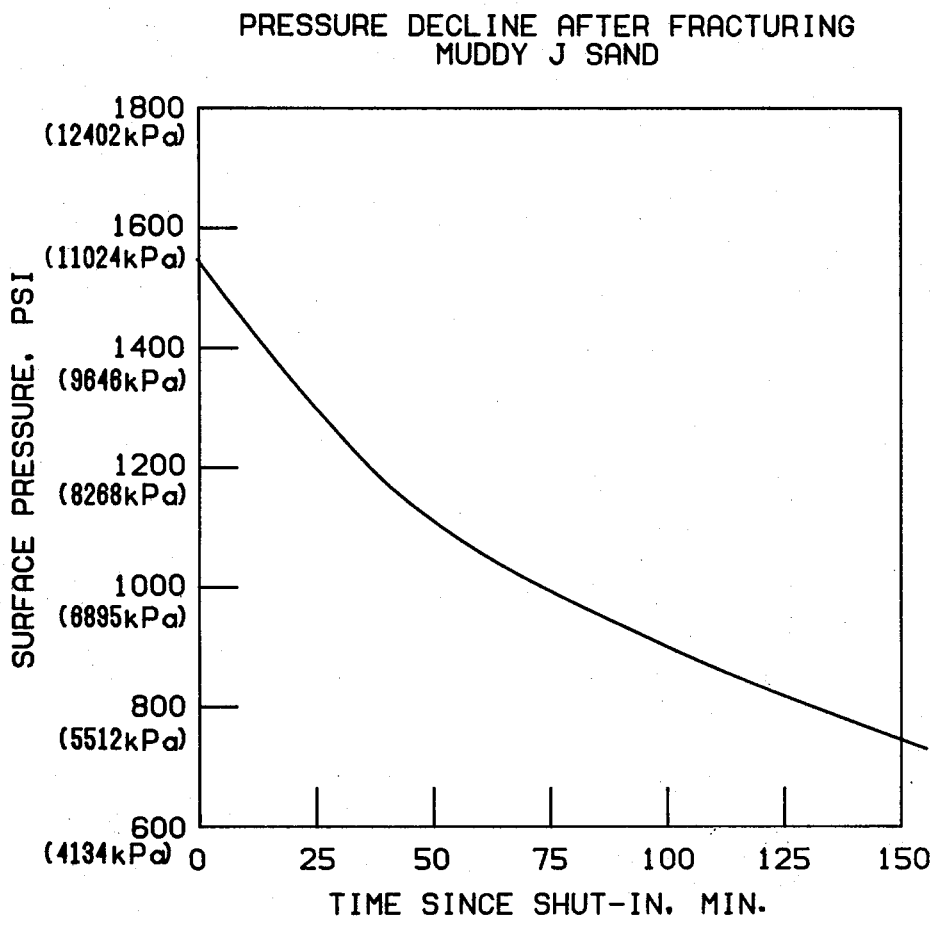
FIG. 1 shows well pressure decline after fracturing.
Figure 2:
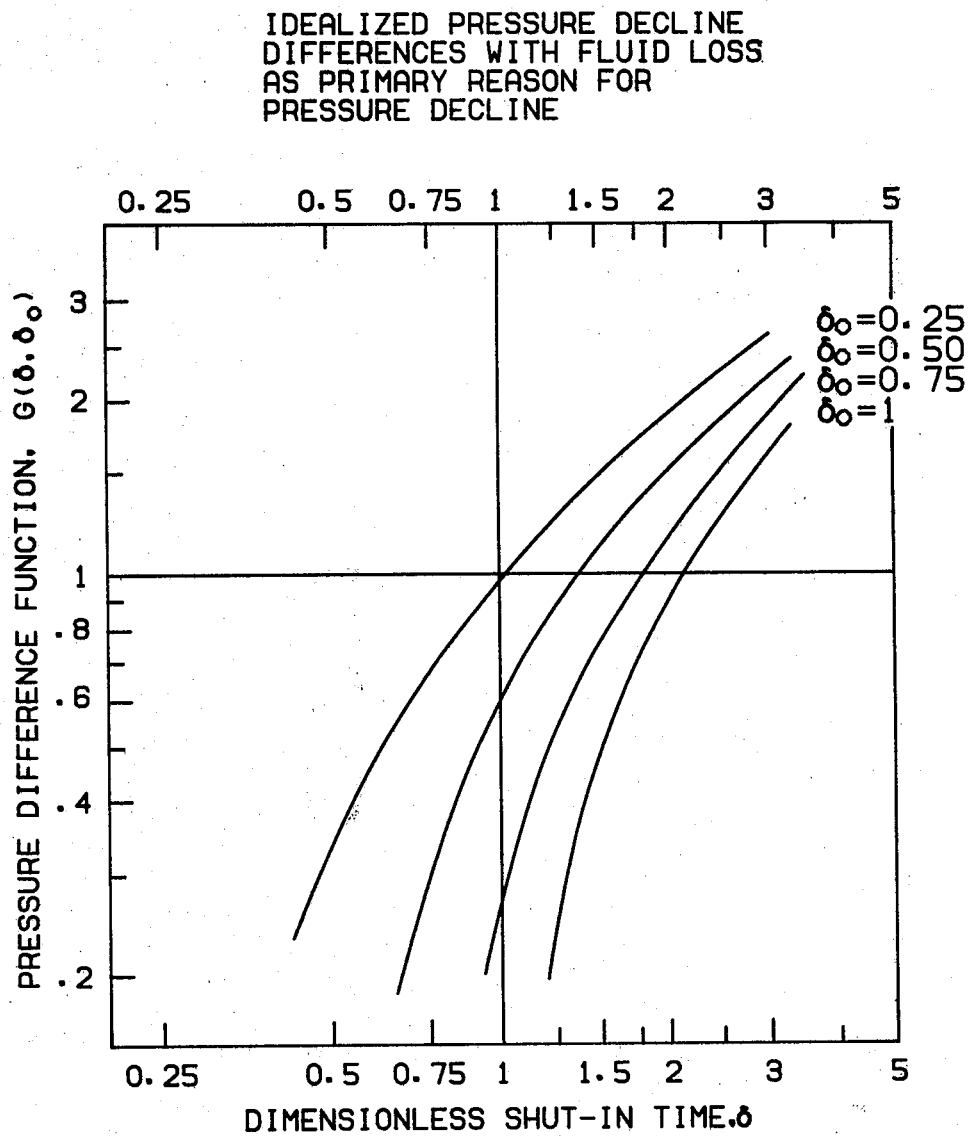
FIG. 2 shows idealized pressure decline differences.
Figure 3:
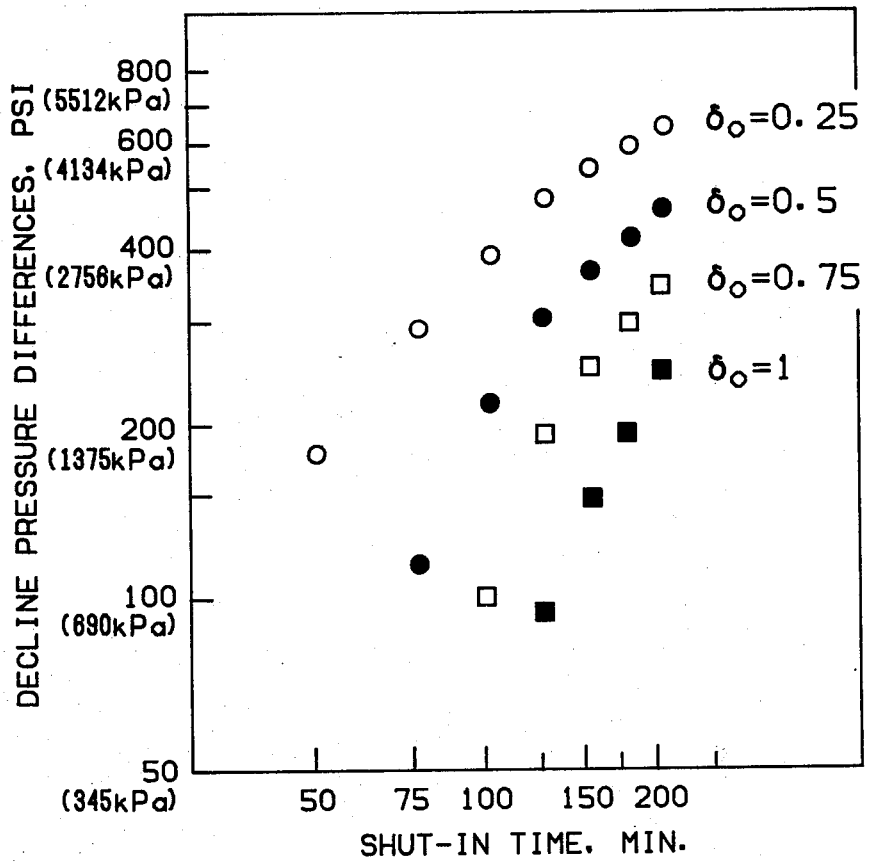
FIG. 3 shows pressure decline differences between reference time and later time after fracturing.
Figure 4:
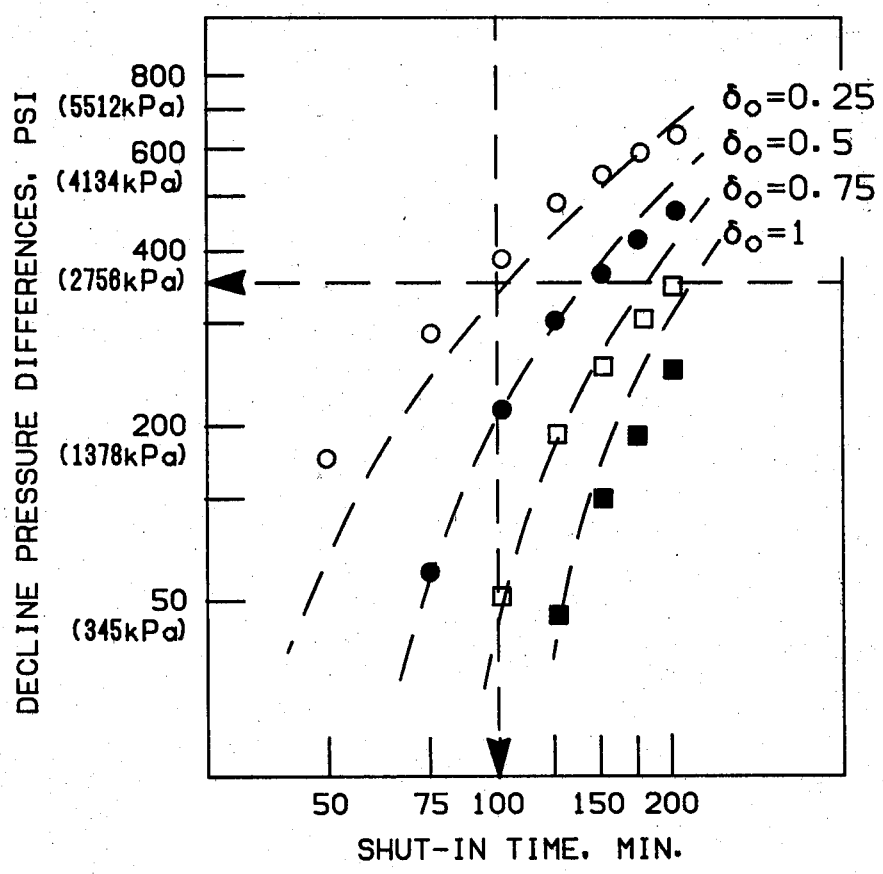
FIG. 4 shows a curve matching procedure.

One method of analyzing the pressure decline curve of FIG. 1, to determine the portions of the curve where the pressure is declining at either a more rapid rate or a slower rate than would be expected when the pressure decline is primarily controlled by the loss of fluid to the formation adjacent to fracture, is illustrated with respect to FIGS. 2, 3 and 4. These figures illustrate a curve matching procedure for determining the portion of the pressure decline curve in FIG. 1 where the pressure decline is attributed primarily to fluid loss.

The four curves shown in FIG. 2 are produced for an idealized difference between the decline pressure corresponding to 25, 50, 75 and 100% of the pump time involved in forming the fracture and decline pressures at later times. The following basic assumptions were made in producing this set of idealized curves. It is assumed that the fracture has essentially a constant height, that it propagates through a quasi-elastic formation with negligible slip of bedding planes, that the fracture was created by a constant injection rate of a power-law fluid into a vertical fracture with two symmetric wings, that propagation stops when pumping stops, and that the fracture closes freely without significant interference from proppant.

The four idealized curves shown on FIG. 2 are plotted with respect to dimensionless shut-in time ($\delta$) and a dimensionless pressure difference $G(\delta_o,\delta)$. The dimensionless shut-in time is calculated by the formula $\delta=\Delta t/t_o$, wherein $\Delta t$ is the time since shut-in and $t_o$ is the pump time, i.e., time during which fluid is introduced into the fracture for forming the fracture. The idealized pressure difference function $G(\delta_o,\delta)$ is proportional to the difference between the pressure at a reference time $\delta_o$ and the pressure at a later time $\delta$.

The curves shown in FIG. 3 were produced from the difference in the actual pressures during the decline curve shown in FIG. 1. The four curves shown in FIG. 3 are for the differences between pressures corresponding to 25, 50, 75 and 100% of the time involved in forming the fracture and the pressure at later times. The fracture decline curves shown in FIG. 1 were produced by pumping fracturing fluid into the fracture prior to shutting the well in and measuring the pressure decline. The curve designated as 0.25 in FIG. 3 was prepared from the differences between the pressure at 25 minutes after shut-in (about 1300 psi, 8957 kPa) and the pressure at later times, i.e., 50 minutes after shut-in (about 1110 psi, 7648 kPa) for a difference of about 190 psi (1309 kPa), 75 minutes after shut-in (about 1000 psi, 6895 kPa) for a difference of about 300 psi (2067 kPa), 100 minutes after shut-in (about 900 psi, 6201 kPa) for a difference of about 400 psi (2756 kPa), and 125 minutes after shut-in (about 820 psi, 5650 kPa) for a difference of about 480 psi (3307 kPa). These curves are plotted on log-log paper using the same scale as used in FIG. 2.

FIG. 4 illustrates the curve matching procedure for using the idealized curves in FIG. 2 for determining the portions of the pressure decline curve of FIG. 1 which represents the pressure decline greater than or less than would be predicted if the pressure decline is primarily due to fluid loss from the fracture. This curve matching procedure is performed by placing the idealized curves of FIG. 2 over the Muddy J fracturing treatment curves of FIG. 3. The dimensionless shut-in time of $\delta=1$ of the idealized curve on FIG. 2 is aligned with the shut-in time of 100 minutes on FIG. 3. The shut-in time of 100 minutes on FIG. 3 is equal to the pumping time required for extending the fracture. The idealized curves are moved along this vertical alignment to obtain the best fit of the idealized curves from the Muddy J treatment.

A comparison of the idealized curves to the curves from the Muddy J treatment are made to determine the periods of time when the pressure declines are above or below what is expected. It is seen from this example that the pressure differences for 50 minutes and 75 minutes, and later times, match the idealized curves for later times up to about 125 minutes. At shut-in times of less than 50 minutes, pressure decline is greater than predicted where fluid loss is the primary factor contributing to pressure decline. It is thought that the rapid pressure decline immediately after shut-in is due to further extension of the fracture. At shut-in times of greater than about 120 minutes, pressure decline is less than is predicted where fluid loss from the complete fracture length is the primary factor contributing to pressure decline. It is thought that the slow rate of pressure decline at times greater than 120 minutes after shut-in is due to the closure of a portion of the fracture.

The fluid loss coefficient for the polyemulsion fracturing fluid used in this Muddy J sand fracturing treatment can be calculated by the following general formula:

$$C = \frac{P^* H^2 \beta_s}{H_p E' \sqrt{t_o}}$$

wherein (C) is the fluid loss coefficient for the fracturing fluid of interest, (P*) is the pressure decline difference for the fracturing fluid which corresponds to the idealized pressure decline difference of $G(\delta_o,\delta)=1$, (H) is the fracture height, ($H_p$) is the fluid loss height, (E') is the plane-strain elastic modulus, ($t_o$) is the pump time for extending the fracture and ($\beta_s$) is the ratio of the average pressure of the fluid within the fracture to the pressure of the fluid in the wellbore with the fracture shut-in.

Figure 5:
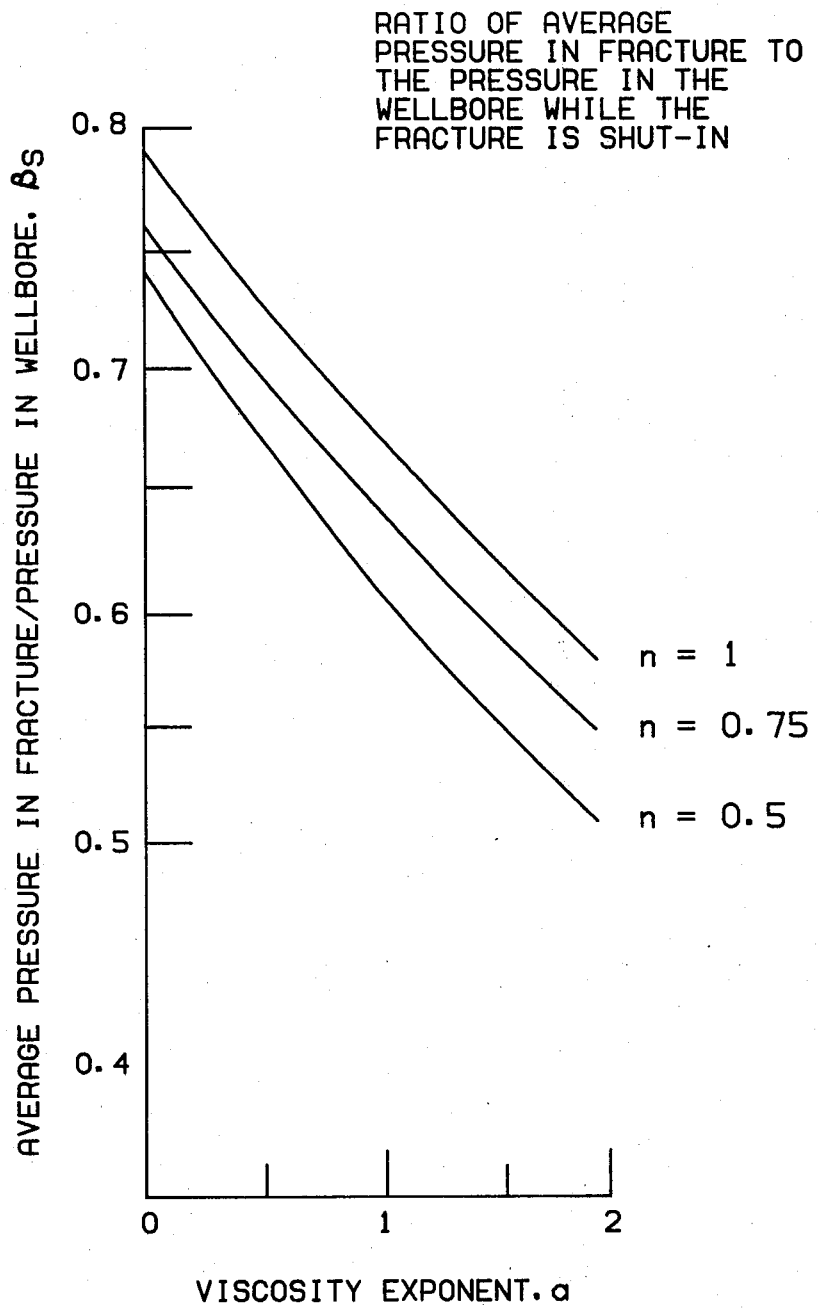
FIG. 5 shows the ratio of average pressure in fracture to the pressure in the wellbore.

The values for $\beta_s$ in FIG. 5 are shown with respect to a viscosity exponent. A viscosity exponent approaching $a=0$ corresponds to a fluid with a viscosity that does not degrade with time. The viscosity exponent $a=1$ corresponds to a fluid with a medium shear degradation rate with respect to time and temperature. The viscosity exponent $a=2$ corresponds to a fracturing fluid with a strong rate of degradation. The three curves shown in FIG. 5 represent the shear sensitivity of the fracturing fluid. A Newtonian fluid, with a low shear sensitivity, has a power-law model exponent (n) value of $n=1$ while (n) values of 0.5 and 0.75 correspond to fracturing fluids with higher rates of shear sensitivity.

The fracturing fluid used in the Muddy J fracturing treatment is considered to be a power-law fluid with $n=0.75$ and a viscosity exponent of $a=1$. The fluid loss coefficient calculated by using this formula for the polyemulsion fracturing fluid used in the Muddy J treatment is calculated as being 0.00053 ft/$\sqrt{\text{min}}$ (0.016 cm/$\sqrt{\text{min}}$). The leak-off rate of this fracturing fluid into the Muddy J sand is determined by multiplying this fluid loss coefficient by the surface area of the fracture from which fluid is lost and dividing the result by the square root of the age of the fracture.

The relationships for determining the idealized pressure decline rate for a fracture and for producing the curves shown in FIG. 2 are shown with respect to the following equations. The basic equation is the continuity equation for flow down a fracture $$-\frac{\partial Q(z,t)}{\partial z} = \lambda(z,t) + \frac{\partial A(z,t)}{\partial t} \quad (1)$$

which states that the gradient of the flow rate is equal to the fluid lost to the formation, per unit length, plus the time rate of fluid storage due to cross-sectional area change.

In equation (1), Q is the pump rate, z is the distance variable down the fracture, t is the time variable, $\lambda$ is the fluid loss per unit fracture length, and A is the cross-sectional area of the fracture.

The basic representation of the loss of the fluid from the fracture is $$\lambda = \frac{2CH_p}{\sqrt{t - \tau(z)}} \quad (2)$$

wherein, C is the fluid loss coefficient, $H_p$ is the height over the fracture which fluid loss occurs and $\tau(z)$ is the time the fracture was created at point z.

With the assumption that negligible slip occurs across bedding planes and that the formation responds quasielastic $$A = \frac{\pi}{4} wH = \frac{\pi H^2}{2E'} p \tag{3}$$

where H is the fractured height, w is the maximum fracture width at point z, p is the pressure on the fluid in the fracture at point z above the in situ closure pressure of the formation, and E' is the effective plane-strain modulus across the fracture height. The effective plane-strain modulus is a constant modulus which gives the same average width across the height for a fracture crossing several zones with different in situ pressures and elastic properties.

Combining Eqs. 1, 2, and 3 and assuming that H and E' do not change significantly with time yields $$-\frac{\partial Q}{\partial z} = \frac{2CH_p}{\sqrt{t-\tau}} + \frac{\pi}{2}\frac{H^2}{E'}\frac{\partial p}{\partial t} \tag{4}$$

Integrating (4) over the length (L) of the fracture and assuming that C, $H_p$, and E' are effectively constant down the fracture yields $$-Q(L) + Q(0) = 2CH_p \int_0^L \frac{dz}{\sqrt{t-\tau(z)}} + \frac{\pi}{2}\frac{H^2}{E'}\int_0^L \frac{\partial p}{\partial t}\, dz \tag{5}$$

Further assuming that the fracture is shut-in (i.e., Q(0)=0) and free extension of the tip after shut-in has ceased (i.e., Q(L)=0), and replacing the above integrals by their average values over the length, (5) can be expressed as $$0 = \frac{2CH_pL}{\sqrt{t_o}} f(t) + \frac{\pi}{2}\frac{H^2}{E'} L \frac{\partial \bar{p}}{\partial t} \tag{6}$$

where $$f(t) = \frac{\sqrt{t_o}}{L}\int_0^L \frac{dz}{\sqrt{t-\tau(z)}} \tag{7}$$

$$\bar{p} = \frac{1}{L}\int_0^L p\, dz = \beta_s P \tag{8}$$

wherein $t_o$ is the injection time prior to shut-in, P is the wellbore pressure, $\beta_s$ is given by Eq. 31 and shown in FIG. 5, f(t) is the pressure decline function, and $\bar{p}$ is the average pressure over the length of the fracture. Combining (6), (7) and (8) gives $$\frac{dP}{dt} = -\frac{4}{\pi}\frac{CH_pE'}{H^2\beta_s\sqrt{t_o}} f(t) \tag{9}$$

The pressure decline function, f(t) can be considered to have upper and lower bounds. The lower bound is influenced by rapid fluid-loss. Therefore, the first term on the right-hand side of (1) dominates the second term to the extent that the second term, for fluid storage, can be neglected. This yields $$z(t) = L(t/t_o)^{\frac{1}{2}} \tag{10}$$

or $$\tau(z) = t_o(z/L)^2$$

where z is the length at time t. The upper bound is influenced by minimal fluid loss. Therefore, the λ term of (1) can be neglected. For this case the equivalent exponent of time in (10) would be 4/5 for a Newtonian fluid. However, an equivalent result for a power-law fluid can be obtained. Integrating (5) with respect to time and neglecting λ yields Qt to be proportional to $\bar{p}L$; and (27) gives $\bar{p}L$ to be proportional to L raised to the 1+1/(2n+2) power, with n being the power-law fluid exponent. Combining these two proportionalities yields $$z(t) = L(t/t_o)^{\frac{2n+2}{2n+3}} \tag{11}$$

Since the exponent in (11) is less than unity for any positive value of n, a more conservative upper bound than (11) is $$z(t) = L\, t/t_o \tag{12}$$

or $$\tau(z) = t_o z/L$$

These bounds can be used for $\tau(z)$ in (7) to bound the value of the integral which defines f(t). It can be shown that using (10) and (12), respectively to evaluate the pressure decline function (7) gives $$f_1(\Delta t/t_o) > f(\Delta t/t_o) > f_2(\Delta t/t_o)$$

$$f_1(\Delta t/t_o) = 2\left(\sqrt{1+\Delta t/t_o} - \sqrt{\Delta t/t_o}\right) \tag{13}$$

$$f_2(\Delta t/t_o) = \sin^{-1}[1-\Delta t/t_o)^{-\frac{1}{2}}] \tag{14}$$

where $f_1$ results from (12) and $f_2$ from (10). $\Delta t/t_o$ is the dimensionless shut-in time in terms of the pump time, $t_o$, and the time since shut-in, Δt. The total time since pumping began is $t=t_o+\Delta t$. In the following $\Delta t/t_o$ will be denoted simply as δ. The bounds are surprisingly close and differ by less than 10% for shut-in times greater than one-quarter the pumping time, i.e., $\Delta t/t_o > 0.25$. As a result, either of the two bounds can be used without compromising the accuracy of (9) due to the larger uncertainty in quantifying the other parameters in (9).

The pressure difference between two shut-in times can be found by integrating (9), using (13), between the two times, i.e., from $\delta_o$ to δ. This gives $$\Delta P(\delta_o,\delta) = \frac{CH_pE'\sqrt{t_o}}{H^2\beta_s} G(\delta,\delta_o) \tag{15}$$

for which $$\delta = \Delta t/t_o$$

$$\Delta P(\delta_o,\delta)=P(\delta_o)-P(\delta)$$

$$G(\delta,\delta_o)=(4/\pi)[g(\delta)-g(\delta_o)] \quad (16)$$

$$g(\delta)=(4/3)[(1+\delta)3/2-\delta 3/2-1]$$

A graph of $G(\delta,\delta_o)$ is shown in FIGS. 2 for $\delta_o$ values selected as 0.25, 0.5, 0.75 and 1. Eq. (15), in terms of pressure differences, is more readily applied to field data than (9). However, (9) can also be used to determine the fluid-loss coefficient. In particular, (15) can be used in terms of curve matching to determine one of the four variables; C, $H_p$, E', or H, if the other three can be quantified from other sources. This is undertaken by plotting $\Delta P(\delta_o,\delta)$ from field data for the $\delta_o$'s corresponding to those in FIG. 2 versus the actual shut-in time $\Delta t$. The field data is plotted on the same log-log scale as FIG. 2 and then FIG. 2 is superimposed on the field data with $\delta=1$ of FIG. 2 aligning vertically with $t_o$, the pump time, of the field data. Then the value of $\Delta P$ from the field data which corresponds to $G(\delta,\delta_o)=1$ of FIG. 2 is the match pressure and is equal to $$P^* = \frac{CH_pE'\sqrt{t_o}}{H^2\beta_s} \quad (17)$$

The curve matching procedure is demonstrated with respect to FIGS. 3 and 4. From this curve-matching procedure, the determined value of P* is equal to the variable group on the right-hand side of (17). The value of $H_p$ can be inferred from well logs, E' from the mechanical property tests on cores, and H from post-fracture temperature logs or other means, and can be used in this procedure for the determination of the fluid-loss coefficient.

$$C = \frac{P^*H^2\beta_s}{H_pE'\sqrt{t_o}} \quad (18)$$

It is important to note that this expression for determining the fluid loss coefficient is independent of the fracture length or the constant injection rate while pumping. Additionally, the power-law flow model will be assumed to represent the flow behavior of a fracturing fluid over the range of conditions generally encountered in fracturing applications. The parameters for this model, as used in the following, are $$\text{Shear stress}=k(\text{shear rate})^n$$

wherein k is a power-law model constant and n is a power-law model exponent. In this model, the pressure gradient is $$\frac{dp}{dz} = 2k\frac{(2mq)^n}{w^{2n+1}} \quad (19)$$

$$m = (2n+1)/n$$

for flow of q (volumetric flow rate per unit height) between walls separated by the width w. The pump rate or total flow rate, Q, down both wings of the fracture is twice the rate down either wing and is found by rearranging (19) and integrating over the cross section.

$$Q = 2\int_{-H/2}^{H/2} q\,dy = \frac{1}{m}\left(\frac{dp}{dz}\ \frac{1}{2k}\right)^{1/n} \times \int_{-H/2}^{H/2} w^m dy$$

or $$Q = \left(\frac{1}{2k}\ \frac{dp}{dz}\right)^{1/n} HW^m\frac{\phi(n)}{dm} \quad (20)$$

where $$\phi(n) = \int_{-\frac{1}{2}}^{\frac{1}{2}}\left(\frac{w}{W}\right)^m d\left(\frac{y}{H}\right) \quad (21)$$

y is the height variable, and W is the maximum cross-sectional width of the fracture at a point z, and the ratio w/W is independent of z. In (20) k and n are assumed to be constant across the section and that dp/dz is assumed to be constant across the section, i.e., one-dimensional flow is assumed. Rearranging (20) yields the proportionality $$\frac{dp}{dz} = \frac{MKQ^n}{H^nW^{2n+1}}\ \alpha\ \frac{KQ^n}{W^{2n+1}} \quad (22)$$

$$M = 2\left(\frac{m}{\phi(n)}\right)^n$$

for the pressure gradient down a constant height fracture. If the fracture responds elastically to internal pressure $$p=SW \quad (23)$$

where S is the fracture stiffness (i.e., S=E'/2H for a constant-height fracture in a homogeneous, infinite, elastic medium), (22) and (23) yield $$p^{2n+1}dp\alpha kQ^n dz \quad (24)$$

for which the fracture stiffness is assumed to be constant.

Assuming k and Q have the exponential relationships $$k=k_o(2z/L)^a$$

$$Q=Q_o(2z/L)^b \quad (25)$$

along the fracture, and integrating (24) from the tip (p=0, z=0) to some distance z toward the wellbore yields $$p(z)\alpha\left[k_oQ_o^n\frac{z^{a+bn+1}}{L^{a+bn}}\right]^{\frac{1}{2n+2}} \quad (26)$$

for which n was assumed effectively to be constant. The average value of p, along the length L of the fracture, from (26) is $$\bar{p} = \frac{1}{L}\int_O^L p(z)\,dz$$

$$\alpha\ \frac{[k_oQ_o^nL]^{\frac{1}{2n+2}}}{(e+1)} \quad (27)$$

-continued $$e = (a + bn + 1)/(2n + 2) \quad (28)$$

Also from (26), the pressure at the wellbore is $$P = p(L)\ \alpha[k_o Q_o^n L]^{\frac{1}{2n+2}} \quad (29)$$

Forming the ratio, $\beta$, of the average pressure over the length of the fracture, $\overline{p}$, from (27), to the pressure at the wellbore, P, from (29) gives $$\overline{p}/P = \beta \quad (30)$$

The ratio $\beta_s$ of the average pressured over the length of the fracture to the pressure at the wellbore during the time that the fracture is shut-in is $$\beta_s = \frac{2n + 2}{2n + 3 + a} \quad (31)$$

implying a nearly constant flow rate, greater than zero, down the fracture for shut-in even though the flow rate is zero at the wellbore and fracture tip. From (25) the variation of k, or equivalent viscosity, can be represented as a=0; constant viscosity a=1; medium degradation a=2; strong degradation (32)

where a reflects the order of magnitude of the decrease in fluid viscosity down the fracture due to temperature, shear and time degradation of fluid system.

The fluid loss coefficient, c, can be used in the following formula for determining the rate which fracturing fluids with similar characteristics will be lost from a fracture during a fracturing treatment in a subterranean formation having similar characteristics.

$$\frac{\text{vol}}{\text{time}} = \frac{C\ (\text{Fluid Loss Area of Fracture})}{\sqrt{t - \tau(z)}}$$

While certain embodiments of the invention are described for illustrative purposes, the invention is not limited thereto. Various modifications or embodiments of the invention will be apparent to those skilled in the art in view of this disclosure. Such modifications or embodiments are within the spirit and scope of this disclosure.

What is claimed is:

1. A method of determining the rate of fracturing fluid loss during a primary hydraulic fracturing treatment of a subterranean formation, which comprises:

measuring the pressure of the fluid in a fracture after a calibration fracturing treatment in said formation has been terminated and during the closure of said fracture wherein said fracture is shut-in such that substantial volumes of said fracturing fluid do not flow from said fracture into said wellbore and said pressure declines after the termination of said fracturing treatment and wherein the fluid in such calibration treatment has similar properties to the fluid to be used in said primary treatment, selecting a period of time during the closure of said fracture while the loss of fluid from said fracture to the formation adjacent to the fracture is the primary factor contributing to said pressure decline, determining the fluid loss characteristics of the fracturing fluid from the rate of pressure decline during said selected period, and calculating the rate of fracturing fluid loss from the fracture during the primary fracturing treatment on the basis that the fracturing fluid used in said primary treatment will have the same fluid loss characteristics as the fracturing fluid used in the calibration treatment.

2. A method of determining the fluid loss characteristics of a fracturing fluid in a fracture extending from a wellbore into a subterranean formation, which comprises:

(a) measuring the pressure of the fluid after a fracturing treatment in said formation has been terminated and during the closure of said fracture, wherein said fracture is shut-in such that substantial volumes of said fracturing fluids does not flow from said fracture into said wellbore and said pressure declines after the termination of said fracturing treatment, (b) representing the differences in the actual pressures during the pressure decline in step (a) with respect to time, (c) representing the idealized difference between the decline pressure relating to the pump time and later decline pressures with respect to time, (d) minimizing the differences of step (b) and step (c) which indicates the period of time during the closure of said fracture while the loss of fluid from said fracture to the formation adjacent to said fracture is the primary factor contributing to said pressure decline, and (e) determining said fluid loss characteristics from said rate of pressure decline during said selected period.

3. A method of determining the rate of fracturing fluid loss during a primary hydraulic fracturing treatment of a subterranean formation, which comprises:

(a) measuring the pressure of the fluid in a fracture after a calibration fracturing treatment in said formation has been terminated and during the closure of said fracture, wherein said fracture is shut-in such that substantial volumes of said fracturing fluid do not flow from said fracture into said wellbore and said pressure decline after the termination of said fracturing treatment and, wherein the fluid in such calibration treatment has similar properties to the fluid to be used in said primary treatment, (b) producing a representation of the differences in the actual pressures during the pressure decline of step (a) with respect to time, (c) producing a representation of the idealized difference between the decline pressures relating to the pump time and later decline pressures with respect to time, (d) minimizing the differences between the representations of step (b) and step (c) to obtain the optimal comparison therebetween which indicates the period of time during the closure of said fracture while the loss of fluid from said fracture to the formation adjacent to the fracture is the primary factor of contributing to said pressure decline, (e) determining the fluid loss characteristics of the fracturing fluid from the rate of pressure decline during said selected period, and (f) calculating the rate of fracturing fluid loss from the fracture during the primary fracturing treatment on the basis that the fracturing fluid used in said primary treatment will have the same fluid loss characteristics as the fracture fluid used in the calibration treatment.

4. A method of determining the fluid loss characteristics of a fracturing fluid in a fracture extending from a wellbore into a subterranean formation, which comprises:

(a) measuring the pressure of the fluid in a fracture after a fracturing treatment in said formation has been terminated and during the closure of said fracture, wherein said fracture is shut-in such that substantial volumes of said fracturing fluid do not flow from said fracture into said wellbore and said pressure declines after the determination of said fracture in treatment, (b) producing a graph of the differences in the actual pressures during the pressure decline in step (a) with respect to time, (c) producing a graph of the idealized difference between the decline pressure relating to the pump time and later decline pressures with respect to time, (d) moving the graph of (b) into proximity with the graph of (c) in moving the graphs with respect to each other to obtain the optimum comparison there between which indicates a period of time during the closure of said fracture while the loss of fluid from said fracture to the formation adjacent to said fracture is the primary factor contributing to said pressure decline, and (e) determining said fluid loss characteristics from said rate to pressure decline during said selected period.

5. Method of determining the rate of fracturing fluid lost during a primary hydraulic fracturing treatment with a subterranean formation, which comprises:

(a) measuring the pressure of the fluid in a fracture after a calibration fracturing treatment in said formation has been terminated and during the closure of said fracture, wherein said fracture is shut-in such that substantial volumes of said fracturing fluid do not flow from said fracture into said wellbore and said pressure declines after the termination of said fracturing treatment and, wherein the fluid in such calibration treatment has similar properties to the fluid to be used in said primary treatment, (b) producing a graph of the differences in the actual pressures during the pressure decline of step (a) with respect to time, (c) producing a graph of the idealized difference between the decline pressure relating to the pump time and a later decline pressures with respect to time, (d) moving the graph of (b) into proximity with the graph of (c) and moving the graphs with respect to the other to obtain the optimum comparison there between which indicates a period time during the closure of said fracture while the loss of fluid from said fracture to the formation adjacent to the fracture is the primary factor contributing to said pressure decline, (e) determining the fluid loss characteristics of the fracturing fluid from the rate of pressure decline during said selected period, and (f) calculating the rate of fracturing fluid loss from the fracture during the primary fracturing treatment on the bases that the fracturing fluid used in said primary treatment will have the said fluid loss characteristics as the fracturing fluid used in the calibration treatment.

6. The method of claim 1, 2, 3, 4, or 5 wherein the fluid loss characteristics of said fracturing fluid are determined from the following relationship $$C = \frac{\pi H^2 \beta_s \sqrt{t_o}}{4 H_p E' f(\delta)} \frac{dP}{dt}$$

C is the fluid loss characteristic of said fracturing fluid, wherein P is the pressure in said wellbore during selected period of time, t is the time during said selected period of time, H is the fracture height, $\beta_s$ is the ratio of the average pressure in the wellbore to the average pressure in the fracture during said selected period of time, $t_0$ is the pumping time for creation of said fracture, $H_p$ is the fluid loss height of the fracture, E′ is plane-strain modulus across the fracture height which will give the same average width across the height of the fracture, and $f(\delta)$ is the pressure decline function which is substantially equal to $$2\left(\sqrt{1 + \Delta t/t_o} - \sqrt{\Delta t/t_o}\right)$$

where $\Delta t$ is the time since said fracture has been shut-in.

* * * * *

UNITED STATES PATENT OFFICE
CERTIFICATE OF CORRECTION

PATENT NO. : 4,398,416

DATED : August 16, 1983

INVENTOR(S) : Kenneth G. Nolte

It is certified that error appears in the above-identified patent and that said Letters Patent are hereby corrected as shown below:

Column 1, line 62, "of" (second occurrence) should be --on--;

Column 5, line 34, in the equation, "$\underset{0}{L}$" should have the integral appearing therein, --$\int_0^L$--;

Column 7, line 5, "3/2-δ3/2-1]" should be --3/2-$_{\delta}$3/2-$_{1}$]--

Column 11, line 39, "to" should be --of--.

Signed and Sealed this

*Nineteenth* Day of *March 1985*

[SEAL]

*Attest:*

DONALD J. QUIGG

*Attesting Officer* *Acting Commissioner of Patents and Trademarks*